US008322806B2

(12) United States Patent
Wright et al.

(10) Patent No.: US 8,322,806 B2
(45) Date of Patent: Dec. 4, 2012

(54) CODING AND MARKING PRINTING SYSTEM

(75) Inventors: Jeffrey Wright, Rowville (AU); Daniel Kent, Ferntree Gully (AU); Mark Van Vegten, Ferntree Gully (AU)

(73) Assignee: Matthews Australasia Pty Ltd, Rowville, Victoria (AU)

( * ) Notice: Subject to any disclaimer, the term of this patent is extended or adjusted under 35 U.S.C. 154(b) by 435 days.

(21) Appl. No.: 12/513,045

(22) PCT Filed: Oct. 30, 2007

(86) PCT No.: PCT/AU2007/001644

§ 371 (c)(1),
(2), (4) Date: Mar. 15, 2010

(87) PCT Pub. No.: WO2008/052257

PCT Pub. Date: May 8, 2008

(65) Prior Publication Data

US 2010/0165028 A1 Jul. 1, 2010

(30) Foreign Application Priority Data

Oct. 30, 2006 (AU) ..... 2006906026

(51) Int. Cl.
*B41J 29/38* (2006.01)

(52) U.S. Cl. ..... 347/5; 347/9; 347/19

(58) Field of Classification Search ..... 347/5, 9, 347/14–15, 19
See application file for complete search history.

(56) References Cited

U.S. PATENT DOCUMENTS

| | | | | |
|---|---|---|---|---|
| 5,644,342 | A | 7/1997 | Argyres | |
| 5,675,365 | A | 10/1997 | Becerra et al. | |
| 7,766,447 | B2 * | 8/2010 | Snyder et al. | 347/19 |
| 2005/0253879 | A1 * | 11/2005 | Yamanobe | 347/5 |

FOREIGN PATENT DOCUMENTS

| | | | |
|---|---|---|---|
| EP | 677388 | B1 | 10/2001 |
| EP | 1713018 | A2 | 10/2006 |

OTHER PUBLICATIONS

Written Opinion and International Search Report mailed Jan. 29, 2008 for PCT Application No. PCT/AU2007/001644.

* cited by examiner

*Primary Examiner* — Lam S Nguyen
(74) *Attorney, Agent, or Firm* — Holland & Hart LLP

(57) ABSTRACT

A method and device for coding and marking printing including defining a print image in dot formation of various sizes and locations; determining and providing a set of individual print control instructions for individually controlling a plurality of dot image print head nozzles to form the defined print image at absolute dot positions; and undertaking the individual control instructions to provide a printed image on a printing substrate corresponding to the defined print image, whereby the system allows for calculated adjustment of each dot position without computational limitation during the printing cycle.

3 Claims, 18 Drawing Sheets

CODING AND MARKING PRINTING SYSTEM

FIELD OF THE INVENTION

This invention relates to a coding and marking printing system for broad repetitive coding and marking of products for product traceability. In one form it is related to a drop on demand printing system but also includes other forms. It is particularly related to an improved system for printing indicia or the like in non-controllable environments such as in printing onto wood, but is not limited to such.

There are many types of printing known. However the uses are limited to the environment of the printing. Clearly very complex printing techniques are usable in printing money currency in the sterile secure environment of the mint. However such techniques are not suitable in other environments.

BACKGROUND ART

Coding and marking printing system includes in one form inkjet coding which falls into two main types. One being DOD (Drop on Demand) and the other is CIJ (Continuous Ink Jet). Drop on demand includes valve based and piezo-electric based systems.

Generally DOD systems have a matrix print generation with a fixed spacing in both the X and Y axes and utilising as the nozzles, a series of in-line plungers, valves or solenoids. Nozzles are either lined up vertically or placed on a fixed angle dependent on size of characters or indicia being printed. The nozzle arrangement is typically a 7, 16 or 32 valve print head. The dot matrix format used to create each character is as little as 5×5 dots up to possibly as many as 32×24 dots. The more dots in each character the better the print quality or "resolution". Due to the dot matrix format of the characters, there is a limit as to what can be printed with the DOD systems that uses a valve, plunger or solenoid type arrangement in-series (fixed spacing) as the nozzles. If they are extremely complex graphic characters, or require high quality, high-resolution printing, then the DOD ink jet printers may not be suitable.

Therefore major drawbacks with known drop on demand printing systems include the fixed spacing and limited dots and fixed size of image, which cause a very restricted dot matrix image with low resolution and not a pleasing effect.

Current methods for driving DOD print head nozzles is in the form of plunger, valves or solenoid in plunger or valve systems and the controlling systems includes hard driving of the plunger/valves/solenoids, by an initiating control. Each valve in the print head is controlled with an On/Off or a common stepped voltage according to a regular pulsed position output. This method of driving can reduce the life of the plunger/valve/solenoid and require larger circuits that use more power and produce more heat. This is a form of stepping the power supply that is feeding the print head, but not stepping the voltage feeding the jets themselves.

By using this method, you are limited to printing in columns only and if the print head is placed on an angle to produce a smaller print height it is possible to introduce a wave into the information printed. This happens because the current systems can only place a dot when the power supply produces the step voltage and the spacing that has been selected.

Therefore substantial restrictions of such systems include the resolution equations for these systems as well as the time to print the image. The more dots per character or image, the slower the printer has to print. The DOD printers produce each dot in turn and therefore if the matrix was a 32×24 as compared to a 5×5, the printer requires 5 times or more time to produce each character in the 32×24 format, thus reducing the overall print speed capabilities.

Traditionally DOD printing technologies cannot print at the same speeds of the CIJ (up to 7.2 m/s). The current DOD systems can only print at speeds of up to 4 m/s. This is due to the processor that is doing the print generation is also initiating the opening and closing of each jet. This takes a lot of effective bandwidth away from the processor, so as the print speed increases the processor bandwidth requirements increase accordingly. Also as the processor bandwidth increases, the DOD print controller and/or controlling system can no longer ensure that the placed dot is of the correct size and placed precisely in the correct position. This causes the print to eventually become illegible.

Therefore a further limitation is the speed and resolution quandary that provides an unacceptable processor limitation in the modern printing industry and an unacceptable heat problem in the solenoids.

The DOD system consists of a pressurized pot of ink or ink pump, which is connected to each nozzle via a manifold and solenoid. These solenoids are then controlled by a print controller, which produces an open or closed situation to allow droplets of ink to be projected from the nozzles at the appropriate time within the restriction of resolution of the regular pulsed position output. The solenoid can either directly control a valve or a print wire is used. In the case of print wire a piece of wire open and closes a port on the print head surface. This wire is controlled via a solenoid. The print wire method cannot print at the same speeds of the directly controlled valve.

A further problem exists in the blockage of the nozzles when idle for a certain time. Generally the longer the idle time, the greater the blockage and the more ink flow pressure required to clear the blockage. However current systems only have an initial start blockage clean.

It is an object of the invention to provide an improved drop on demand printing system that overcomes or at least ameliorates one or more of the problems of the prior art and allows for more detailed definition of image.

BRIEF SUMMARY OF THE INVENTION

In accordance with the invention there is provided a coding and marking printing system using a plurality of print heads for printing, the system including a print drive interface connectable to the print heads and a control system for receiving a rendered image and connected to the print drive interface for controlling the print heads; wherein the control system has a plurality of instructions to individually control each print head according to an inputted rendered image and a determined dot formation representation of the rendered image.

The control system includes encoder, and printer logic core having core printer functions, which through a jet drive interface communicate with the jet bank interface to drive the print heads.

The printer logic core of the control system includes a data address interface that receives a plurality of instructions from control system, wherein the processor controls the initiation and the time of action of each print head. The control system can drive the print heads by a step voltage over a predefined step timing and a respective hold voltage over a determined hold timing dependent on the respective dot portion of the determined dot formation representation of the inputted rendered image. The step timing can have an effective predetermined range to allow print head operation without possible damage. The hold timing can have an effective predetermined range to allow print head operation to required range of dot size formation without possible damage.

The control system and the print drive interface are on a defined digital means for at least a rendered image such as on a FPGA (field programmable gate array) an OTP, ASIC or other hard copy silicon chip. In this way the power of the central processing unit undertaking the rendering is not affected by the separate operation of driving the print heads.

The invention provides a drop on demand printing system including a plurality of print head nozzles for drop on demand printing and connectable to an ink feed; a jet bank interface connected to the print head nozzles; and a control system for controlling the release of the ink by the print head nozzles connected to the jet bank interface by defining a plurality of instructions to individually control the release of the ink of each print head nozzle according to an inputted image and a determined dot formation representation of the image.

The control system can include encoder, and printer logic core having core printer functions, which through the jet drive interface communicate with the jet bank interface to drive the print head nozzles.

The printer logic core of the control system includes a data address interface that receives a plurality of instructions from a processor (CPU), wherein the processor can control the initiation of the release and the time of the release of the ink of each print head nozzle.

The control system can drive the print head nozzles by a step voltage over a predefined step timing and a respective hold voltage over a determined hold timing dependent on the respective dot portion of the determined dot formation representation of the inputted image.

Also in accordance with the invention there is provided a method of drop on demand printing including the steps of:

defining a print image in dot formation of various sizes and locations;

determining and providing a set of individual print control instructions for individually controlling a plurality of dot image print head nozzles to form the defined print image; and undertaking the individual control instructions to provide a printed image on a printing substrate corresponding to the defined print image.

Due to the separation of the step of determining and providing a set of control instructions, to the step of undertaking the individual control instructions allows the system to not be restricted by the limitations of the processor and also allows for calculated adjustment of each dot position without computational limitation during the printing cycle.

The method can undertake the defining of the print image and the determining and providing of a set of individual print control instructions separate and preferably before the beginning of the undertaking of the individual control instructions.

The definition of the print image can be in final form and the step of determining and providing a set of individual print control instructions includes consideration of relative positioning of dot image print head nozzles and relative movement of dot image print head nozzles to the printing substrate.

The print image can be defined using absolute positioning of dots in at least one direction and substantially only limited by the size of the dots. Therefore the system can allow for definition of position of dots anywhere along the X-axis of the print lines.

The determining and provision of a set of individual print control instructions can be such that no processing is required for the undertaking of the individual control instructions.

The print image can be defined by vector graphics, vector fonts and scaled bitmaps/images. Since the image can be rendered to print head nozzle commands prior to printing and not rely on processor bandwidth then the image can be defined by vector graphics and vector image. Further it is no longer necessary to define a compensated image to be rendered for control taking into consideration the limitations and errors of the system. Instead the current system can render the image or character as required and the computational definition of each dot point can separately take into consideration the initial errors or individual compensation and no cumulative errors can occur during the printing cycle.

The individual print control instructions can include for each defined dot formation an instruction for a logic controlled print head nozzle.

The individual print control instructions can include consideration of the plurality of dot image print head nozzles being in a fixed array and the provision of relative movement of the fixed array to the printing substrate.

The individual print control instructions can include for each defined dot formation a definition of location determined by a fixed time according to position of the dot image print head nozzles and the speed of relative movement of the fixed array to the printing substrate.

The system particularly can take into account the angle of the print head which is undertaken for resolution requirements in the Y axis and for character height and instead of requiring the image to be rendered in a similar leaning manner can be rendered in normal view and the dot position calculated separately for each dot taking into consideration the initial print head nozzle offset.

The system can have the print heads interlaced in both the X and Y axis. When the print heads are interlaced in the X axis the result is improved print speed/performance, but when interlaced in the Y axis it greatly improves the printer's resolution capabilities.

The individual print control instructions can include for each defined dot formation a definition of size of dot to be printed. Therefore due to the availability of changing size of dot and being able to allow the next dot to be positioned and the required spaced position rather than at a predefined resolution spacing the current system offers the ability for a much more detailed and realistic rendering of the printed image or character.

The individual print control instructions can include for each defined dot formation an initiation signal for initiating the release of ink released from any one of a plurality of print head nozzles connected to an ink feed.

The control signal can further provide a hold signal for continuing the release of ink released from any one or more of the plurality of print head nozzles.

The initiation signal can be a step voltage.

The hold signal can be a controlled hold voltage at a lower voltage than the step voltage.

The individual print control instructions can include for each defined dot formation a dot formation control signal for controlling the manner of release of ink released from any one of a plurality of print head nozzles connected to an ink feed.

The dot formation control signal can be to shape the dot formed.

The dot formation control signal can be to control a pulse width modulated controlled print head nozzle.

The dot formation control signal can be to control a frequency based controlled print head nozzle.

The dot formation control signal can be to control a bit stream controlled print head nozzle The method of drop on demand printing can include the step of placing any one or more of plurality of print head nozzles at a predefined relative position to the printing substrate.

The predefined relative position of print head nozzles to the printing substrate can be an absolute position in at least one direction and a position determined by the spacing of print head nozzles in a transverse direction.

The step of placing any one or more of plurality of print head nozzles at a predefined relative position to the printing substrate can include arranging the print head nozzles in a linear array and moving a printing substrate relative to the linear array such that a pathway set of parallel linear lines occurs with the spacing of dots determined over a continuous range along the linear pathways and spaced according to the spacing of the print head nozzles in the array.

Adjustment of position along the linear pathways is determined in consideration of the relative speed of the printing substrate to the array of print head nozzles.

Adjustment of the relative spacing of the linear pathways is defined by the distance of the print head nozzles in the array and the angle of the linear array relative to the direction of movement of the printing substrate.

The plurality of linear arrays of print head nozzles can be overlapping and the determining and providing a set of individual print control instructions for individually controlling a plurality of dot image print head nozzles to form the print image can take into account the particular print head nozzle to undertake the printing and the particular related offset calculation required in the rendering process.

It can be seen that such overlapping allows for the creation of unlimited size image or character. It further allows resolution to be substantially unrestricted in the Y-axis and if there is a resolution limitation of a first set of linear array of nozzles the overlapping linear array can be offset and thereby bisect the continuous X axis print line and thereby double the resolution in the Y-axis. Further overlapping or different spacing can alter the resolution at different ratios as required.

The use of overlapping arrays of print head nozzles also particularly allows DOD to be used for three-colour printing and overcomes the alignment problems of reprinting over a first print colour.

The invention also provides a drop on demand printing system including:

- a plurality of print head nozzles for drop on demand printing and connectable to an ink feed;
- a control system for controlling the release of the ink by the print head nozzles; and
- a processor for defining a plurality of instructions for the control system to individually control the release of the ink of each print head nozzle according to an image and a determined dot formation representation of the image;
- wherein the processor can define the initiation of the release.

The processor can also define the hold time of the release of the ink of each print head nozzle.

The control system undertaking the individual control instructions can be performed by a plurality of logic semiconductor controllers without requirement for a processor in the printing stage.

The control system can include a means for supplying a step voltage for controlling the initiation of the release and a means for maintaining a hold voltage for controlling the length of the time of the release in order to print a required dot size.

The system can include a plurality of linear arrays of print head nozzles wherein the plurality of linear arrays can be arranged relative to each in a predefined arrangement such that the processor for defining a plurality of instructions for the control system to individually control the release of the ink of each print head nozzle according to an image can determine and provide a set of individual print control instructions for individually controlling the plurality of linear arrays of dot image print head nozzles to form the print image taking into account the relative position of the plurality of linear arrays.

In one form the plurality of linear arrays are offset to each other to allow relative close spacing of the arrays.

Preferably the plurality of linear arrays do not overlap each other and together can form an image of a size greater than one linear array.

The nozzles of the plurality of linear arrays can be spaced relative to each other to continue the same resolution of the linear path of one linear array to another.

It can be seen that the system of the invention allows the control of the absolute position of drop on demand dot position in at least one axis but can also provide substantial control of the position of drop on demand dot position in intersecting axis. The result is the capability of high resolution printing and the printing of a complex greyscale image and the printing of colour image which all are now possible by means of the drop on demand printing system of the invention.

It can therefore be seen that the system of the invention with the Print Engine Module, does not have speed limitations until you reach very high speeds. These speeds need to reach equal or greater than 4 m/s. The system is also generating at these speeds with up to 64 dot height characters and is not limited to 32 high. When the system is networked, the heights of the characters become much greater. For example if there is two system networked, you have the potential to produce a character of 128 dots, etc Further the system does not have the same print speed limitations. Once the printer processor has rendered the print job it is passed to the logic based print driver. Since the print driver is logic based and each jet is handled as an individual, the system can uniquely achieve print speeds in excess of 10 m/s.

In the system the processor is doing more of a supervisory role. Once the print is generated the processor has no more involvement in placing the dots. This information is passed to the high speed logic core which interrogates signals from the speed pulse encoder and print triggers. With this information the high speed logic can place the dots (to form the character and/or graphic images) independent of the processor and allows the processor to continue with other housekeeping items. By using this method the system has the unique capability to ensure that both the size and position of each individual dot is correct and will not change in size or position depending on processor loading.

The system has the unique capability to print very complex characters, shapes and pictures. This is due to the method of control developed in the system has over each individual jet and the print generation method that the system uses.

Also in accordance with the invention there is provided a way that the system "discovers" the connected nozzles on the system and the type of nozzle/printhead that are connected. Presently, the current systems in the market either do not interrogate the connected print heads or they perform a simple loop back in the cables. The loop backs do not detect the printhead itself it detects via voltage the cable type and there assumes the type of printhead connected. Our system will do a combination of two functions.

Firstly a small voltage is applied on the nozzle itself and then reads the voltage coining back to work out the resistance.

This reveals that the system has a printhead connected and whether the printhead connected is 12 or 24V.

The next step will be the system to undertake an impedance check. This is done to determine the print head type and cable length. A fixed frequency is passed down to the jet of 3.3 volts. The system then converts the frequency from the print head back to a voltage and then samples it. This information is used in a look up table to determine the print head type and what dot size adjustments need to be made. This information is used to determine the cable impedance and the jet impedance to adjust the dot size that this jet will be printing and adjust the dot size timing to give us a consistent dot size regardless of the cable type and length attached. The known prior art systems have to limit the cable length from the controller because over distance they loose control of the dot size.

In addition another development is that currently ink can dry out in the nozzles when the printhead has not printed for a period of time. In the industry this is referred to as "Head Open Time". The result is typically the first print performed by a particular print head in an array after a time is poor print quality at the start of the message. To overcome this, if the jet has not been fired for a extended period of time the system will allow for the drying in the nozzles by timing idle time of the jet since it was last fired. The system will then calculate if the dot size needs to be increased to increase ink flow pressure to unblock the print head nozzle.

The system can now manage the individual nozzle head open time and compensate for the individual dot sizes regardless of when they are required to print in the message. Basically the longer each nozzle does not print; the new system has the capability to extend the firing of each individual nozzle (up to a certain value) for a longer period to ensure the appropriate dot size is achieved. No current system has this capability. Typically a system will increase the dot size at the start of the message for all the nozzles that are required to print only. Therefore nozzles that do not print, have the blocking issue.

The system can also determine if it is safe to print a given dot. In conventional DOD systems the DOD printer will print a dot every time it is instructed to. This is fine for low speed printing, but as the print speed increases there is a possibility for a dot to be printer while it is still printing a dot. When this happens the conventional printers will reactivate the same jet (issuing a new step drive over the already active jet). If this is happening continuously it will destroy the jet dew to it being over driven. This is not the case with this system. Whilst it is printing the system checks to see it is safe to print the next dot. This is done by checking to see if it is currently printing a dot on the selected jet and if another dot is requested then the system will deem it not safe to drop the dot and it will be removed from the print buffer.

BRIEF DESCRIPTION OF THE DRAWINGS

In order that the invention can be more readily understood an embodiment will be shown by way of illustration only with reference to the drawings wherein.

DESCRIPTION OF PREFERRED EMBODIMENT OF THE INVENTION

Figure 1:
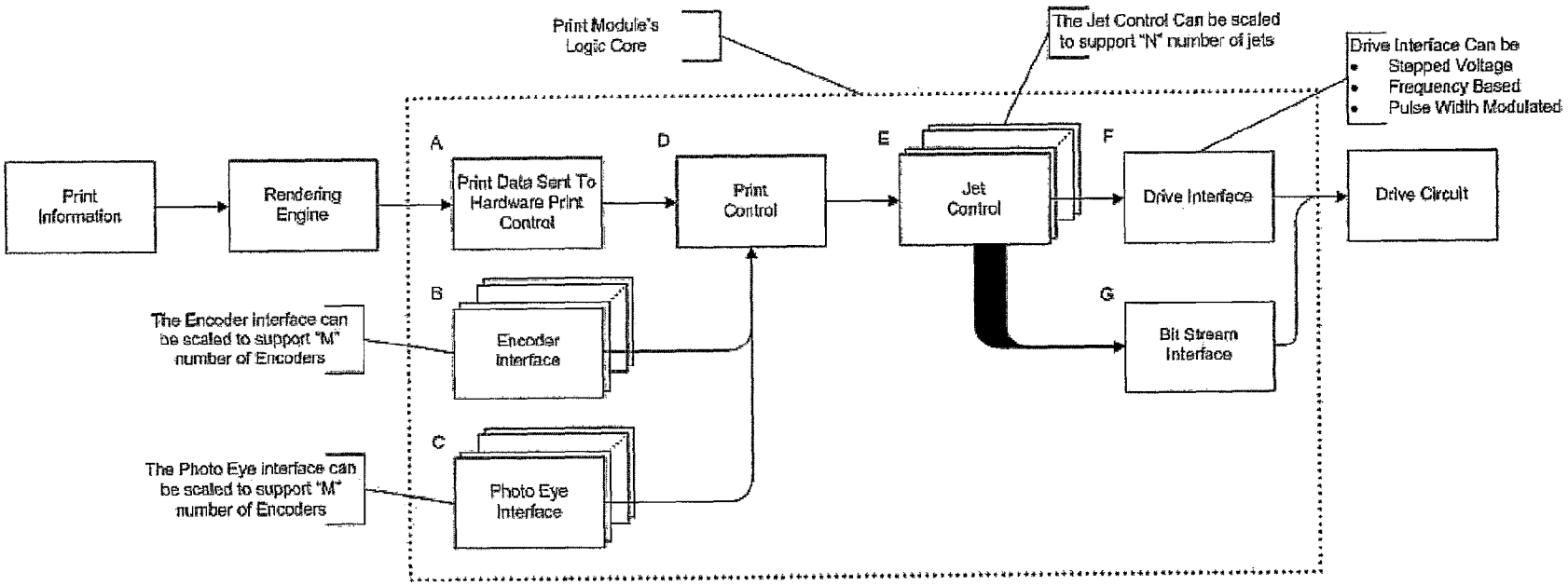
FIG. 1 is a diagrammatic overview of the operational components of the coding and marking printing system in accordance with an embodiment of the invention.

Referring to the drawing there is shown in FIG. 1 a drop on demand printing system which includes a plurality of print head nozzles for drop on demand printing and connectable to an ink feed. These print head nozzles are connected to the jet bank interface. The system further has a control system for controlling the release of the ink by the print head nozzles connected to the jet bank interface. This control system includes encoder, and printer logic core having core printer functions, which through the jet drive interface communicate with the jet bank interface to drive the print head nozzles. The printer logic core of the control system includes a data address interface that receives a plurality of instructions from a processor (CPU) for defining a plurality of instructions for the control system to individually control the release of the ink of each print head nozzle according to an image and a determined dot formation representation of the image wherein the processor can control the initiation of the release and the time of the release of the ink of each print head nozzle.

Figure 2:
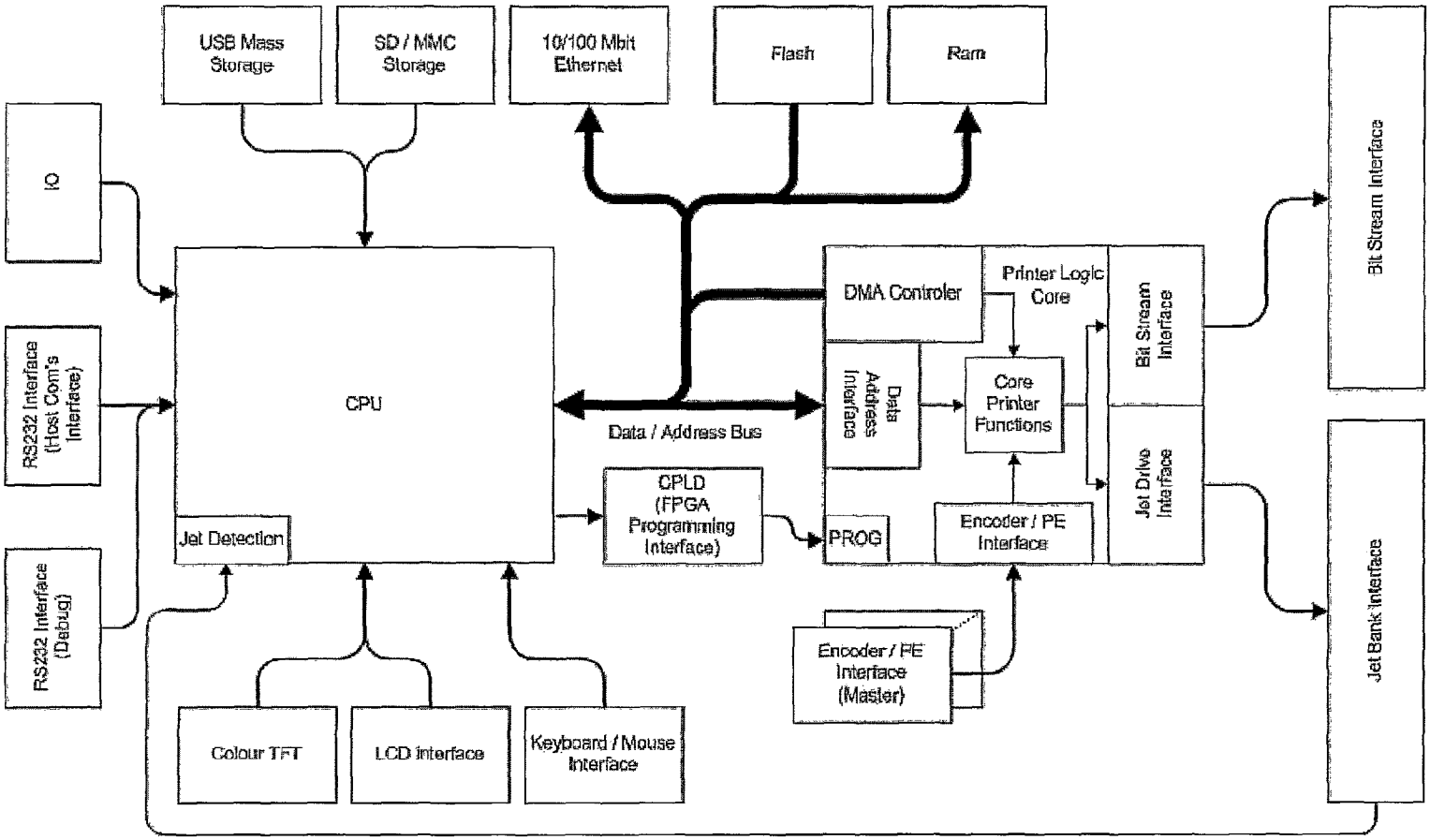
FIG. 2 is a diagrammatic overview of the printer hardware in accordance with an embodiment of the invention.
Figure 3:
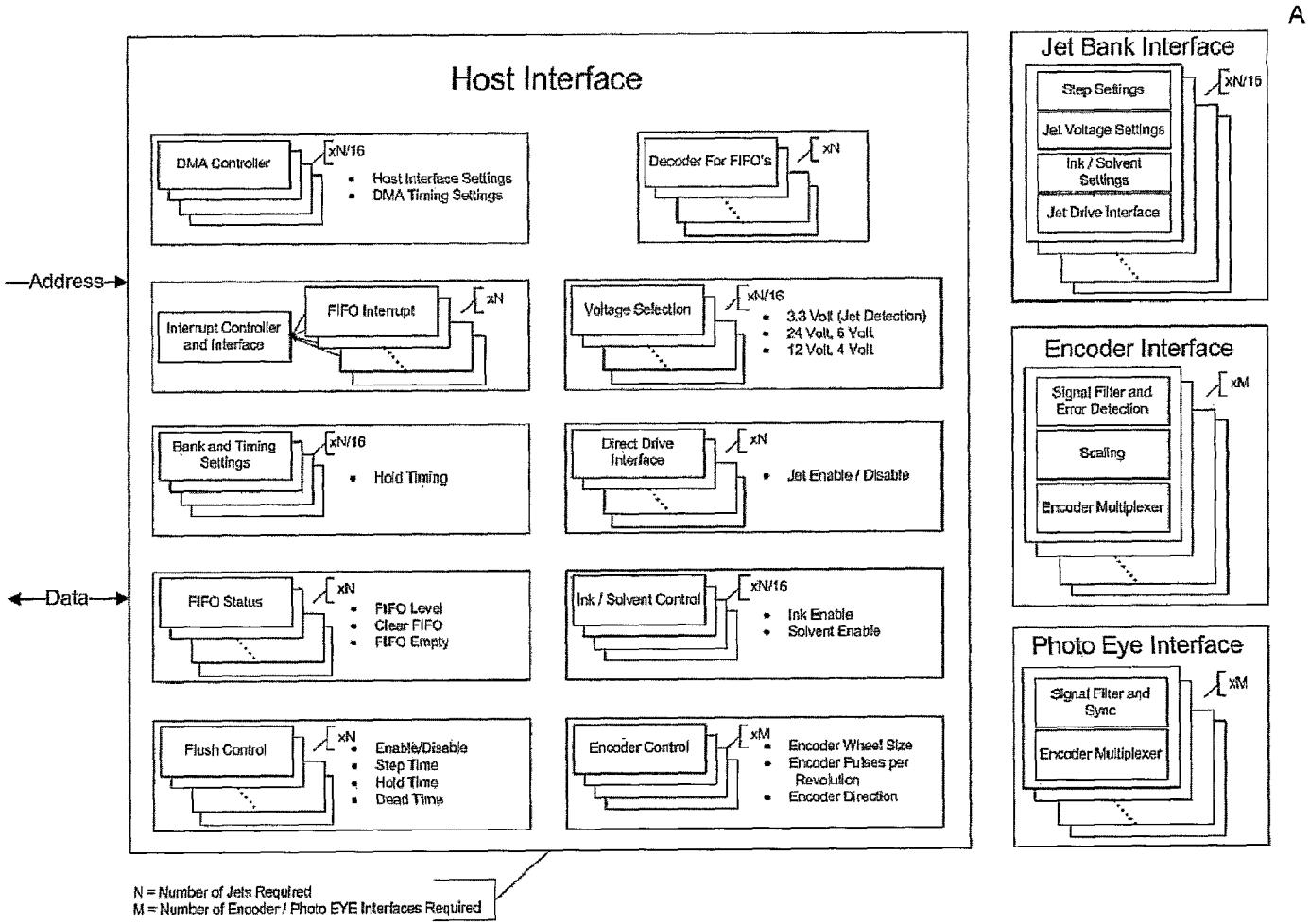
FIG. 3 is a diagrammatic overview of the print module logic core of FIG. 1 controlling the print head jets in accordance with an embodiment of the invention
Figure 4:
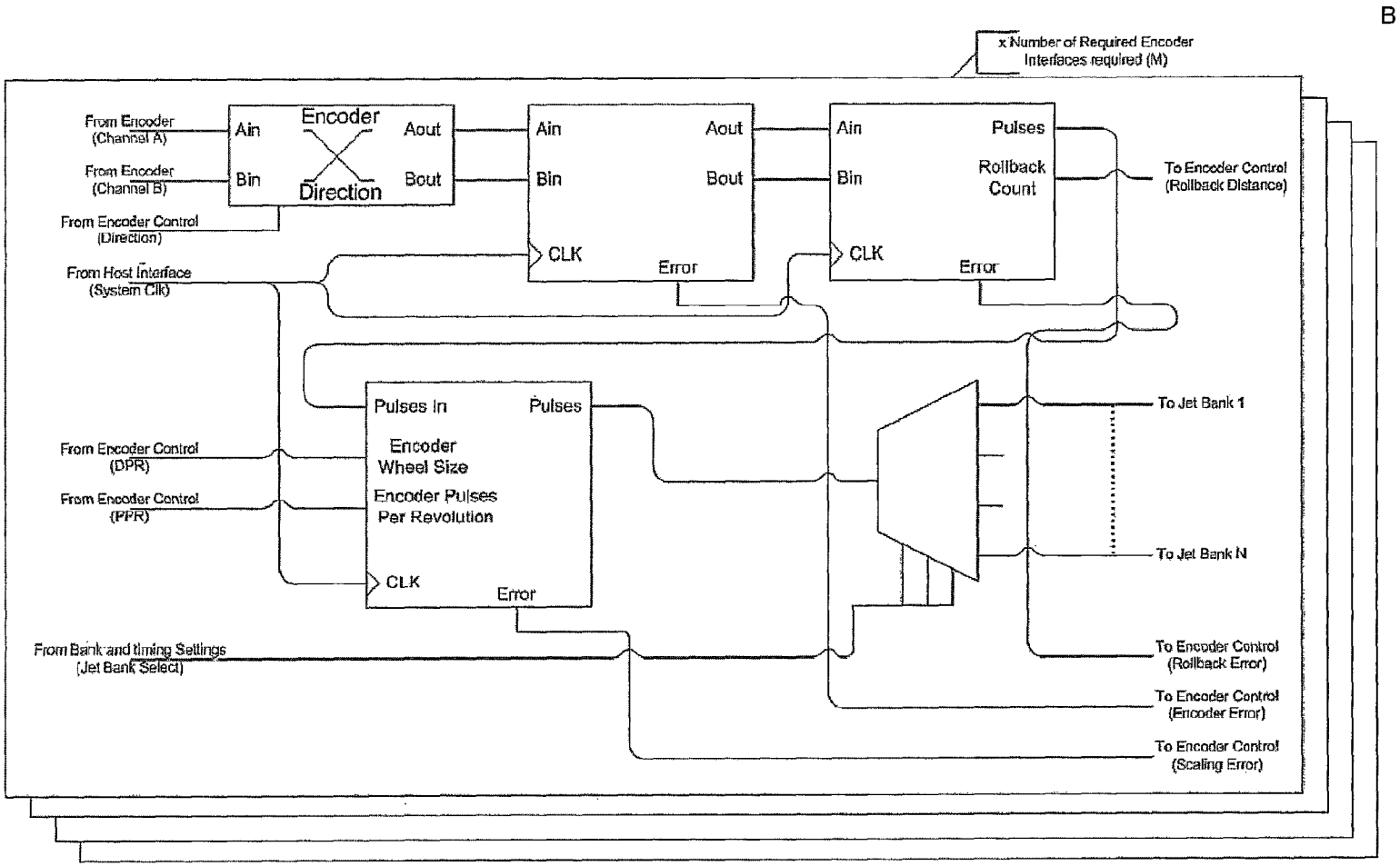
FIG. 4 is a diagrammatic overview of the encoder system of the printer system of FIG. 1 in accordance with an embodiment of the invention

In FIG. 2 there is shown an over view of the control unit and its logic core. The host interface allows the CPU to access all of the control registers. These registers control all of the printer's functions. The host interfaces are as follows:

- Encoder Interface (×M, where M is the number of required Encoder/PE interfaces required)
  - Set the encoder wheel size (in 0.01 mm resolution)
  - Set the encoder pulses pre revolution
  - Set which jet bank will be using the pulse information from the given encoder input Photo Eye interface (×M, where M is the number of required Encoder/PE interfaces required)
Set which jet bank will be using the pulse information from the given PE input
Jet Bank Interface (×N/16, where N is the number of Jets required)
Set the jet step time (in 10 uS increments)
Set the Voltage requirements for the given bank of jets
Set the ink and solvent selection settings
DMA interface
DMA Timing Control
DMA Memory Access Settings
Interrupt Interface
Enabling and Disabling of the Jet Interrupts The system of the invention uniquely drives the jets differently to any DOD print controller and/or DOD controlling system by:

The Voltage for the Hold and Step can be changed
Adjustable timing for both the Hold and Step voltages The Voltages that can be selected are based on the two common voltages used in the DOD solenoid based printing technologies. These voltages are the step voltage, which can be selected between 24 Volts and 12 Volts, and the hold voltage, based on the step voltage selected. If the step voltage is 24 volts then the hold voltage is 6 volts, otherwise if the Step voltage is 12 volts then the hold voltage is 4 volts.

Although the signals for the jet drive interface can be left on indefinitely, this will cause detrimental damage to the plunger/valve/solenoid. For this reason, the system has limited the signal timings to the step timing have been limited to run between 10 μS to 350 μS. This allows for ample time for the plunger/valve/solenoid to open and not cause any damage. Also the hold timing has been limited to a maximum of 512 μS. This allows for the largest possible dot size for this type of printing technology. These timings are maintained regardless whether the CPU controlling the printing is functioning or not. The Logic/Circuit cannot physically drive these signals any longer than the above timings and run independent of the Controlling CPU. These technologies can be driven for longer periods of time, but doing this has no advantage as the consequence will be the possibility of damaging both the drive circuitry and the print head.

By the system the hold time can be different for each dot that is placed. By varying the timing for the hold voltage you increase the size of the dot printed. Since the system can uniquely adjust the hold timing for each dot placed, the system can uniquely produce greyscale print in varying the bold print without printing two dots sequentially; which is the current method of producing bold print on existing DOD systems.

The current DOD Print Controllers and/or DOD controlling systems fix a dot size for an entire message selected to print. This means that for all of the nozzles on the print heads attached to the printer control unit, they all must run with the same dot size for the entire message. Unfortunately this means that it is impossible to produce a greyscale print and if you want to print a bold section of print you need to print two dots one after the other, this will stretch the word, image or object that is being printed.

With the drive circuit of the system of the invention, it allows the system to drive each dot with a different dot size. This overcomes the issue of bold printing and allows the flexibility to change the boldness of print for each individual nozzle, which provides the unique capability of greyscale printing, basic shadowing, etc, on a DOD system.

The system drives the plunger/valves/solenoids not in Column placement but in Absolute Dot Placement. That is, the system uniquely controls each row of jets individually and as each is driven independently from each other the spacing is no longer a concern.

The current DOD Print Controllers and/or DOD controlling systems print in what is referred to as column based print generation. This methodology is fine if you only require a dot matrix print and that each print head connected is mounted at 100% of its print height. However, if the print head is not mounted at 100% print height, in a tilted or slanted angle, the system can introduce a wave in the print.

For example, a current DOD system with a 16 valve print head, with a dot pitch (distance from the centre of a jet to the centre of the next jet) of 4 mm with a print spacing of 0.8 mm and a print height of 25% (this is not a worst cast situation) you would have the following % of Error in print alignment:

| Jet Number | X Position (mm) | Spacing Error (mm) | % Error |
|---|---|---|---|
| 1 | 0.0 | 0 | 0.0 |
| 2 | 1.5 | 0.1 | 1.1 |
| 3 | 3.1 | 0.2 | 2.2 |
| 4 | 4.6 | 0.3 | 3.2 |
| 5 | 6.1 | 0.3 | 4.3 |
| 6 | 7.7 | 0.4 | 5.4 |
| 7 | 9.2 | 0.5 | 6.5 |
| 8 | 10.7 | 0.4 | 4.9 |
| 9 | 12.2 | 0.3 | 3.8 |
| 10 | 13.8 | 0.2 | 2.8 |
| 11 | 15.3 | 0.1 | 1.7 |
| 12 | 16.8 | 0.0 | 0.6 |
| 13 | 18.4 | 0.0 | 0.5 |
| 14 | 20.0 | 0.1 | 1.6 |
| 15 | 21.4 | 0.2 | 2.7 |
| 16 | 23.0 | 0.3 | 3.7 |

The errors that are introduced into the printing will vary depending on the print height and spacing. In general you will not see the wave in the print until you have a dot shift around 0.5 mm. Also the dot size that is being used can also mask this issue. (I.e. the larger the dot size, the more the ink will bleed into the substrate.), which makes the dots touch thereby lessening the issue but not removing it.

The system can uniquely vary each individual dot placement from about 0.01 mm to in-excess of 100 m dependent on required scaling. During the high speed logic print generation stage the system calculates the position of each dot at the required resolution and can place them to that accuracy. The resolution that is typically used is 0.01 mm, but this can be changes to a smaller/larger resolution depending on the print head technology that is being used. This accuracy can only be achieved if the system has the correct pulse encoder attached to it.

The current DOD Print Controllers and/or DOD controlling systems can print a single job across multiple control units. However, these systems do not maintain the aspect ratio of the generated print.

Figure 5:
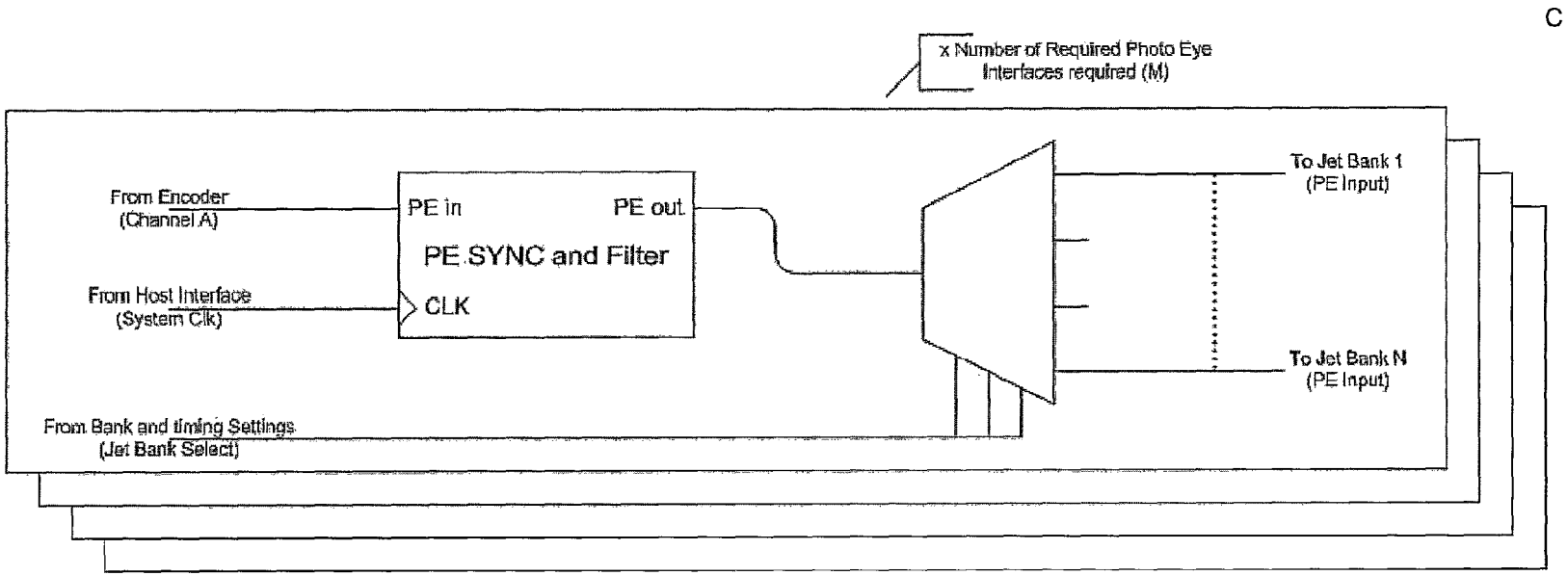
FIG. 5 is a diagrammatic overview of the photo eye interface of the printer system of FIG. 1 in accordance with an embodiment of the invention
Figure 6:
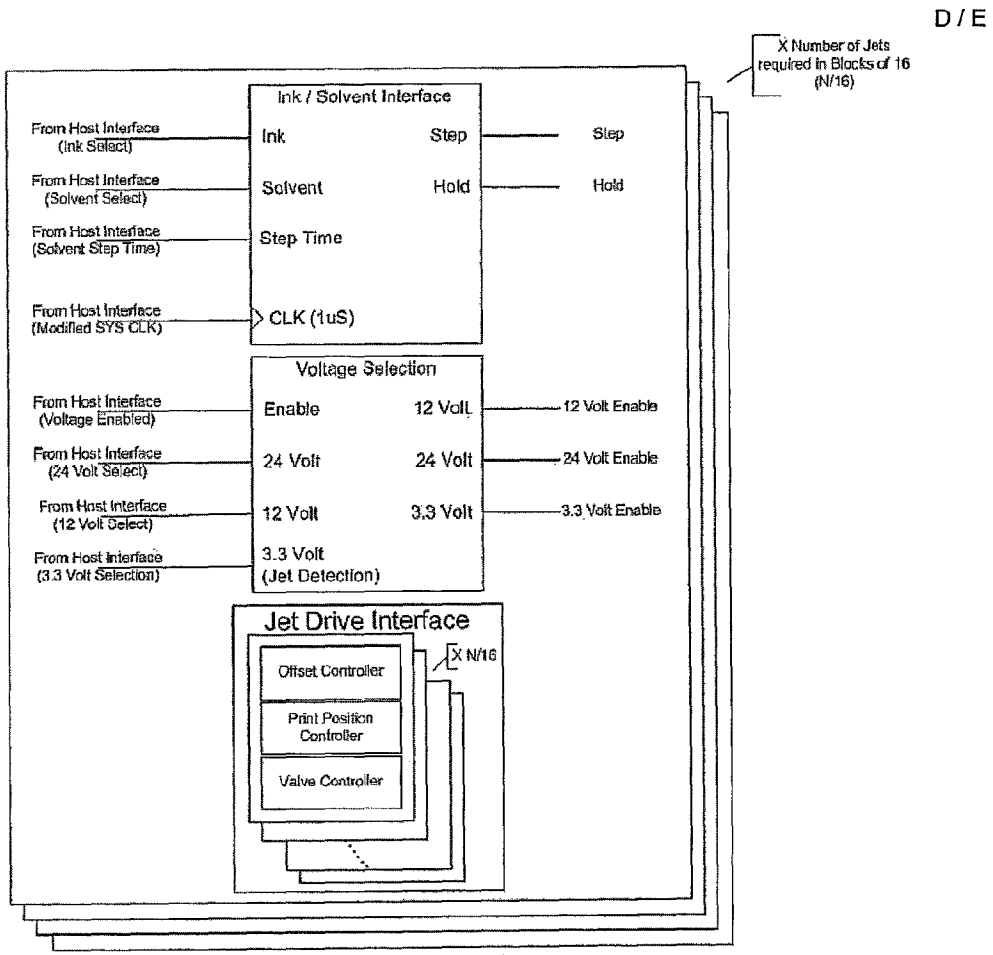
FIG. 6 is a diagrammatic overview of the jet control of the printer system of FIG. 1 in accordance with an embodiment of the invention
Figure 7:
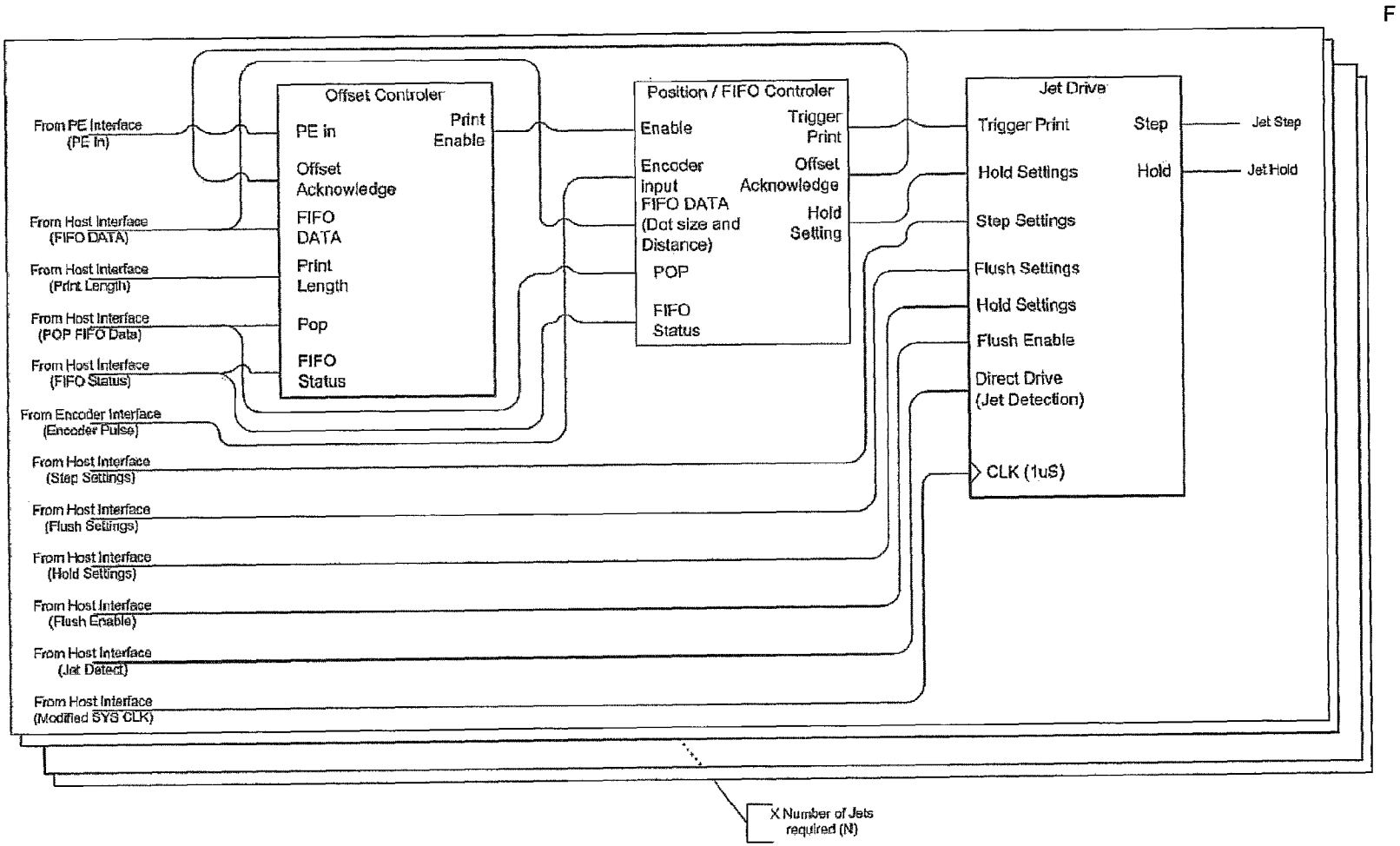
FIG. 7 is a diagrammatic overview of the drive interface of the printer system of FIG. 1 in accordance with an embodiment of the invention

Referring to FIGS. 5, 6 and 7, the printer system of the present invention can print a single print job across multiple control units. The print generation is not limited to having characters starting and finishing on the same control unit. The objects can be split and the system will still maintain the aspect ratio of the generated print. Since the printers in the network each know what print heads are attached to them and their position in relation to each other print head, the system has the unique capability, due to the high speed logic, to work out what part of the current format relates to which print head and generated the print accordingly.

FIG. 5 represents the unique difference between a standard DOD print generation and the print generation of the current system of the invention. The current system can calculate and compensate for the predefined offset print head positions and therefore it is able to continue the line being printed and the line does not have any shifting (as the standard DOD). The standard DOD printers do not use print head position information in the print generation, so when they are printing across multiple systems they cannot maintain the aspect ratio of what is being print and shift the print.

This can only be achieved if the printers are on the same network and are given the same print information to generate.

Standard DOD control units can only deal with print heads stacked on top of each other and these print heads must all have the same angle. For example, a current DOD system with two 16 valve print heads connected to a standard 32 valve DOD controller, the system would have to have the first jet from each print head sitting above each other. This limits the angle that you can have the print heads on due to the size constraints of the print heads.

The DOD system can uniquely control the exact position of each connected printhead as well as having the unique capability of placing the print heads on various angles The system is also not constrained to a single print head type per system. This is particularly shown on the left side of FIG. 7 where the plurality of linear arrays of print head nozzles are at differing angles to each other but the resultant image can be printed across all of the arrays.

Figure 8:
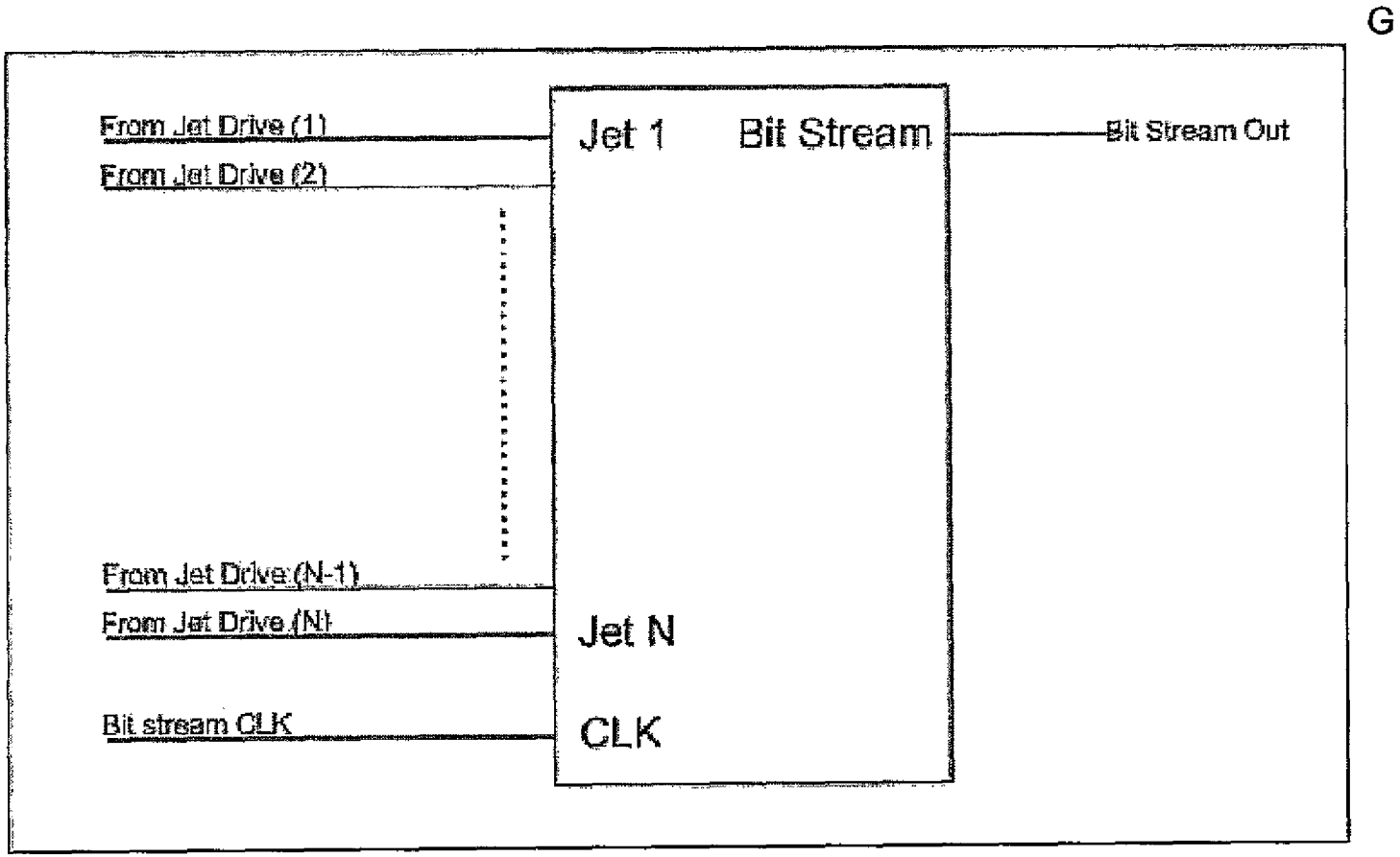
FIG. 8 is a diagrammatic overview of the bit stream interface of the printer system of FIG. 1 in accordance with an embodiment of the invention

Referring to FIG. 8 there is shown the encoder interface of the control unit, which allows the printer's logic core to access up to M (Where M is the number of PE/Encoder interfaces required) independent rotary encoders. Typically the system has 4 encoder interfaces, each of these encoders can have unique settings associated to them and also be configured to interact with one or more jet banks. The encoder interface is broken up into 5 individual stages.

Firstly the system has the ability to set the direction of the attached encoder. This is to allow for standard wiring and mounting of the encoders.

Secondly there is provided encoder filter, error detection and synchronisation. In this section the "A" and "B" channels of encoder are synchronised with the systems 100 MHz clock. Once this is done the channels Phase and levels are check to ensure that the signals are valid. If the signals are not valid the system will then flag an encoder error and state what the error was. If the signals are valid then they are passed onto the rollback module Thirdly there is an encoder rollback module, which has the ability to track the direction of the encoder movement and allow for the system to roll in the reverse direction and not affect the print. After the rollback module has determined the direction of travel it preforms a ×4 multiplier on the encoder pulses. This is done to improve accuracy for the encoder pulses that are running through the system. The system does this be looking at the phase difference between the "A" and "B" channel. Since the two channels are 90° out of phase we can synthesize a pulse for each (four) state changes. The rollback module then takes this modified signal and checks to see if the encoder has rolled in the reverse direction. If it has rolled in the reverse direction, the module will start to count the distance that has been traveled backwards and stops passing out encoder pulses. Once the encoder travels in the forwards from travelling in the reverse direction, the rollback module will start to decrement the distance that was traveled until it reaches the point it started travelling backwards. If the rollback counter is zero the rollback module will start passing encoder pulses out again.

Fourthly there is provided a scaler. The system scales the encoder pulses to produce a pulse that happens once every about 0.01 mm or other scale as required. This is done using the encoder pulses per revolution and the encoder distance per revolution information passed to the encoder module.

Fifthly an encoder output multiplexer allows the scaled encoder information to be routed into one or many jet banks.

Figure 9:
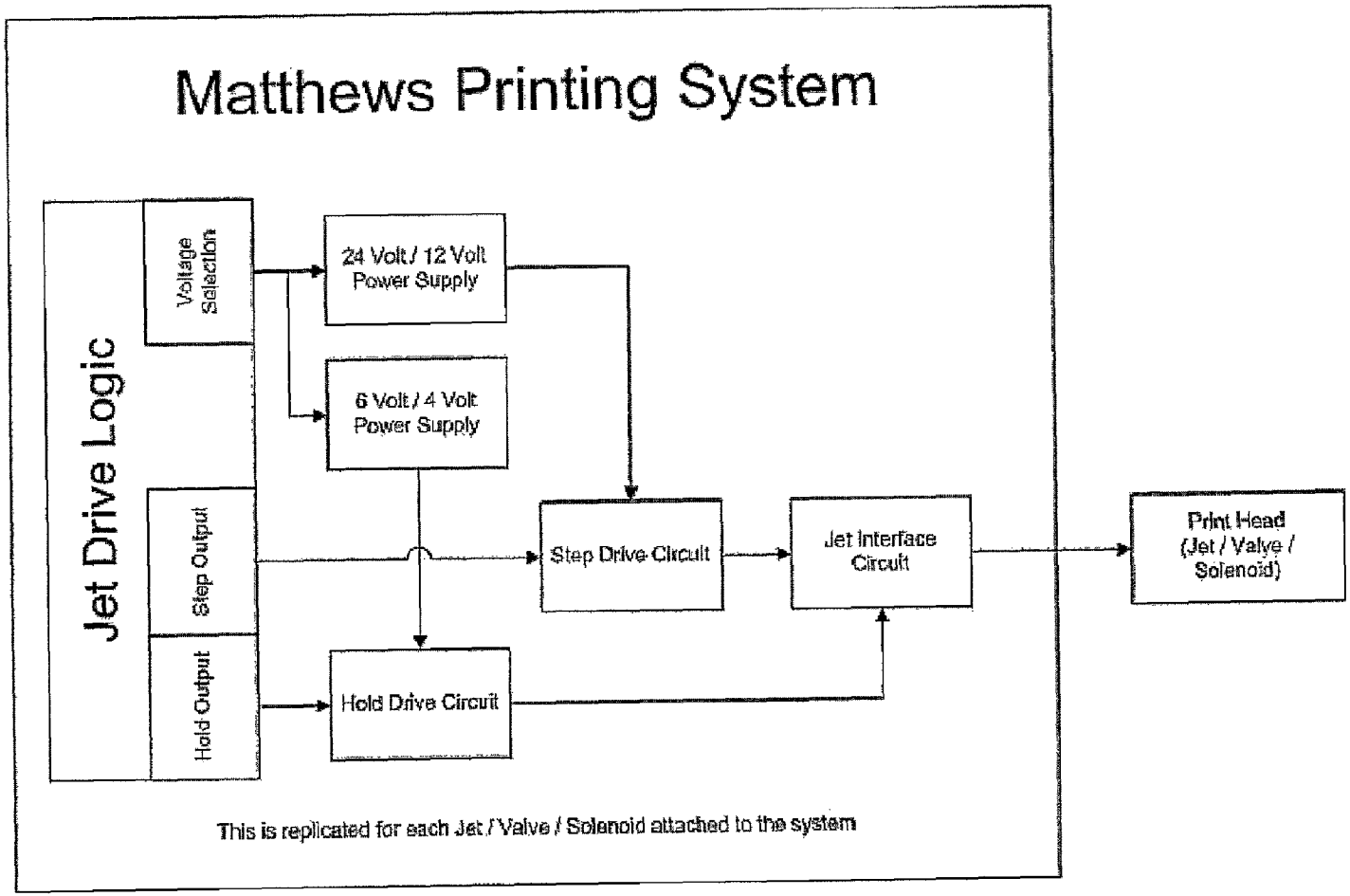
FIGS. 9 and 10 is a diagrammatic view of the general system of control and the print head control signal used in the printer logic core controlling the printhead jets and comprising a step voltage followed by a hold voltage.

Referring to FIG. 9 there is a jet bank interface controls 16 of the Jet Drive interfaces, enables and sets the voltages for the connected print heads. The jet bank interface also produces the step voltage required to run the ink and solvent solenoids. An ink and solvent selection module allows the printer to select between the ink and solvent solenoids in the print heads. When the solenoid is activated a step voltage is produced. The hold time for the step voltage can be specified and adjusted if required. A voltage selection allows the print engine to turn off a given print head if it is not required. This module can also select between 24 volt and 12 volt technology. During the print head detection stage of the power up sequence, the 3.3 volt output is selected.

Figure 10:
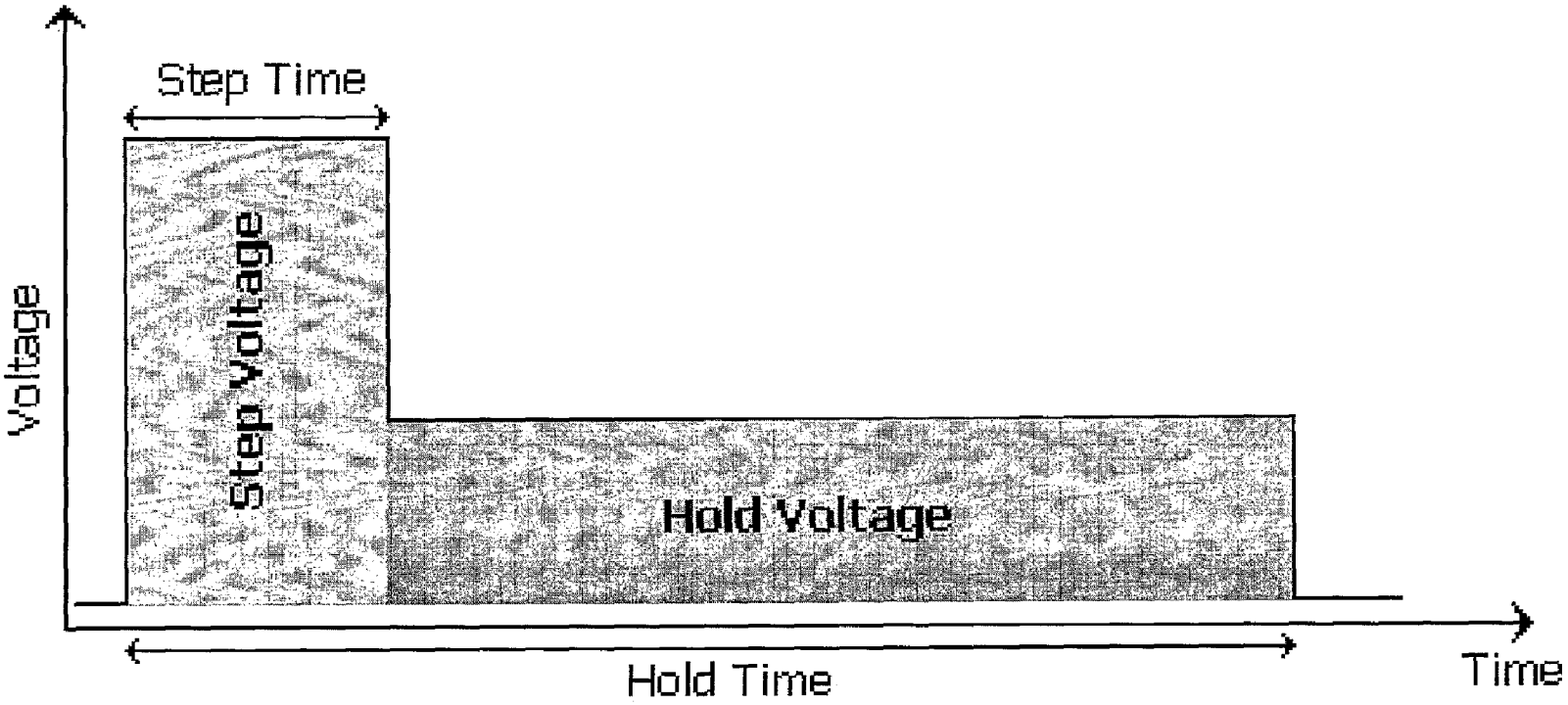

Referring to FIG. 10 the jet drive interface is where all of the work is done. This module is broken up into 3 major parts of an offset module, a position and FIFO control and a jet drive.

The offset control allows for the initial position offset for the start of the print message (allowing for print head angle and distance from the PE). Once the offset distance has elapsed it passes control to the position and FIFO control module. The offset control module then waits until the position control module has finished the current print job and instructs it to start the offset process again.

Once the offset control has taken care of the initial print offset, the position and FIFO control takes over for the rest of the given print job. This module will pop the next position and dot size information off the jet bank's FIFO. Once it has the new information it will wait until the specified distance has elapsed. The module tells the Jet drive that it needs to place a dot and also passes the dot size that needs to be placed. Once it has started the placement of the current dot, it will pop of the next position and start waiting for the distance to elapse. This process will continue until the entire print job is completed. When the print job is completed it will pass control back to the offset control module The jet drive produces the step voltage required to place the dot, it also has the ability to change the dot size if it deems it is necessary. The way the system determines that it is necessary to change the dot size is based on the following things:

- During the print head detection stage the system tests for
  - Print head resistance
  - Print head impedance
  - With these two pieces of information the system can increase or decrease the dot size for a given dot. If the resistance and impedance values are used in an internal look up table to work out how much the jet needs to be changed by to produce a consistent dot.
  - By doing this we can allow for standard wear and tear on the print head, cable length and still be able to maintain a consistent dot across all of the jets.
- If the jet has not been fired for a extended period of time the system will allow for the drying of the in the nozzles this is done by timing the time from the last time the jet was fired to the next time it is fired. The system will then calculate if the dot size needs to be increased.

The jet drive is also controlling the automated jet flush tasks. When the system is not printing a print job, the mode of the jet drive can be changed to run an automated flush. The automated flush uses three timing values. These are:—Jet step, Jet hold and Jet dead time. The jet step and jet hold timings are used to produce the standard step pulse, but the jet dead time is use to set the time delay between the firing the next dot. The automated flush will run continuously until it is instructed to turn off.

The jet detection drive system is also located the jet drive module. The detection cct (circuit) uses two methods to work out what print head is attached to the system.

The first method is to preform a resistance check. With this check we can detect if the head is a 12 volt or 24 volt print head. This is done by passing a current limited short 3.3 volt pulse into the jet that is being tested. The voltage that is being applied to the jet will not have enough current to allow the jet to fire a dot, but be enough to let the system read solenoid's resistance. Once this is done the system will read back the voltage. This is compared to a table of voltages and the print head is then determined.

The second method is an impedance check. This is done to determine the print head type and cable length. This information is used to adjust the dot size that this jet will be printing. A fixed frequency is passed down to the jet of 3.3 volts. The frequency that is passed at 3.3 volts is also current limited to ensure that the jet will not fire a dot, but will have enough current to enable the system to read back the coil reactance voltage. The system then samples the voltage that is across the solenoid. This information is used in a look up table to determine the print head type and what dot size adjustments need to be made.

During the testing stage the system also checks to see if any of the jets have the ability to function correctly. This is determined by the solenoid's resistance and impedance. If the resistance or impedance values that are read back are out side a given set of bounds the jet will be deemed faulty. If it finds a jet that is damaged it will flag a system warning and tell the operator that the print head needs some attention.

Figure 11:
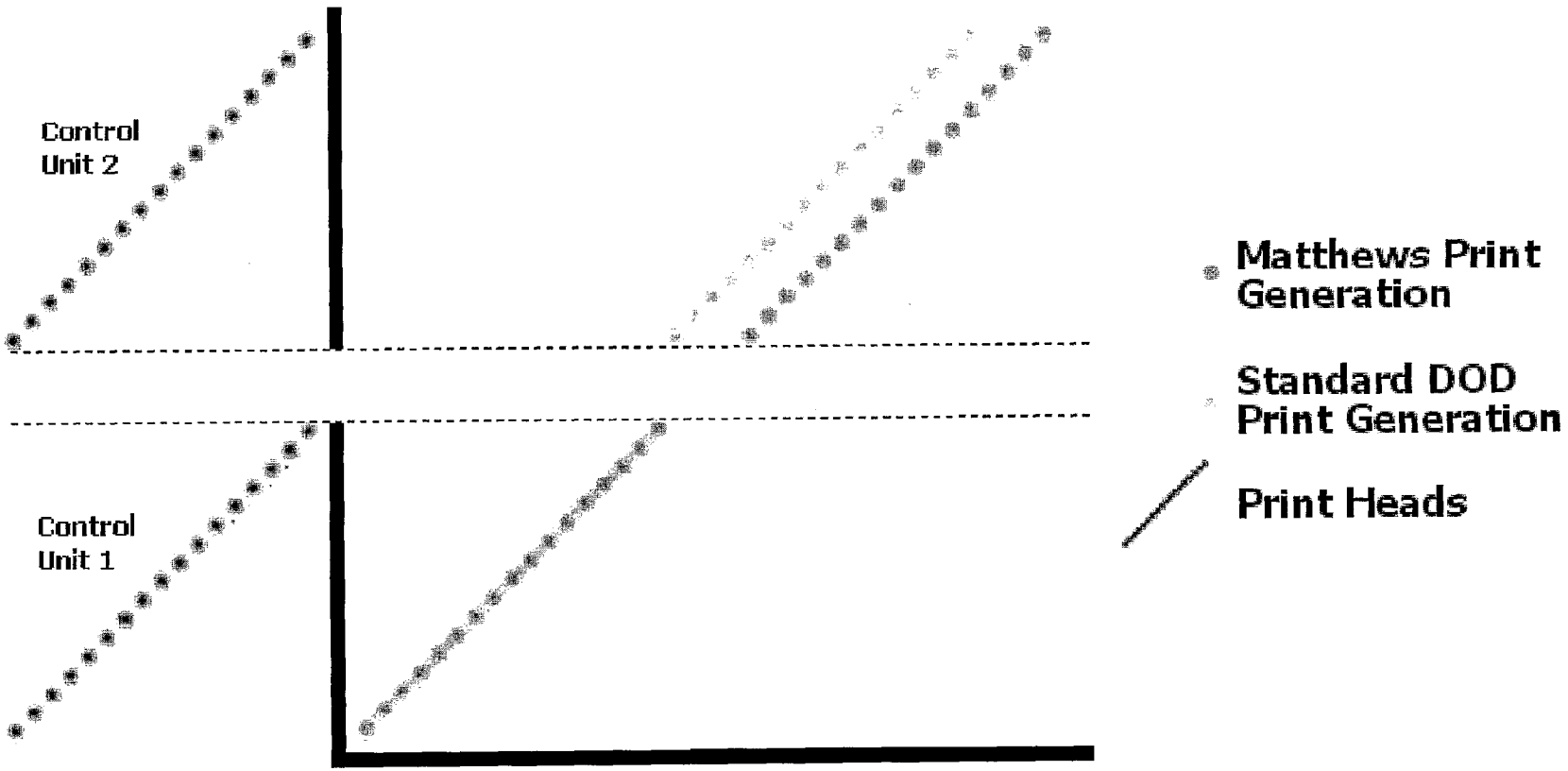
FIGS. 11, 12 and 13 are diagrammatic views of printing results using multiple print heads in the system of an embodiment of the invention in comparison with other multiple head systems.
Figure 12:
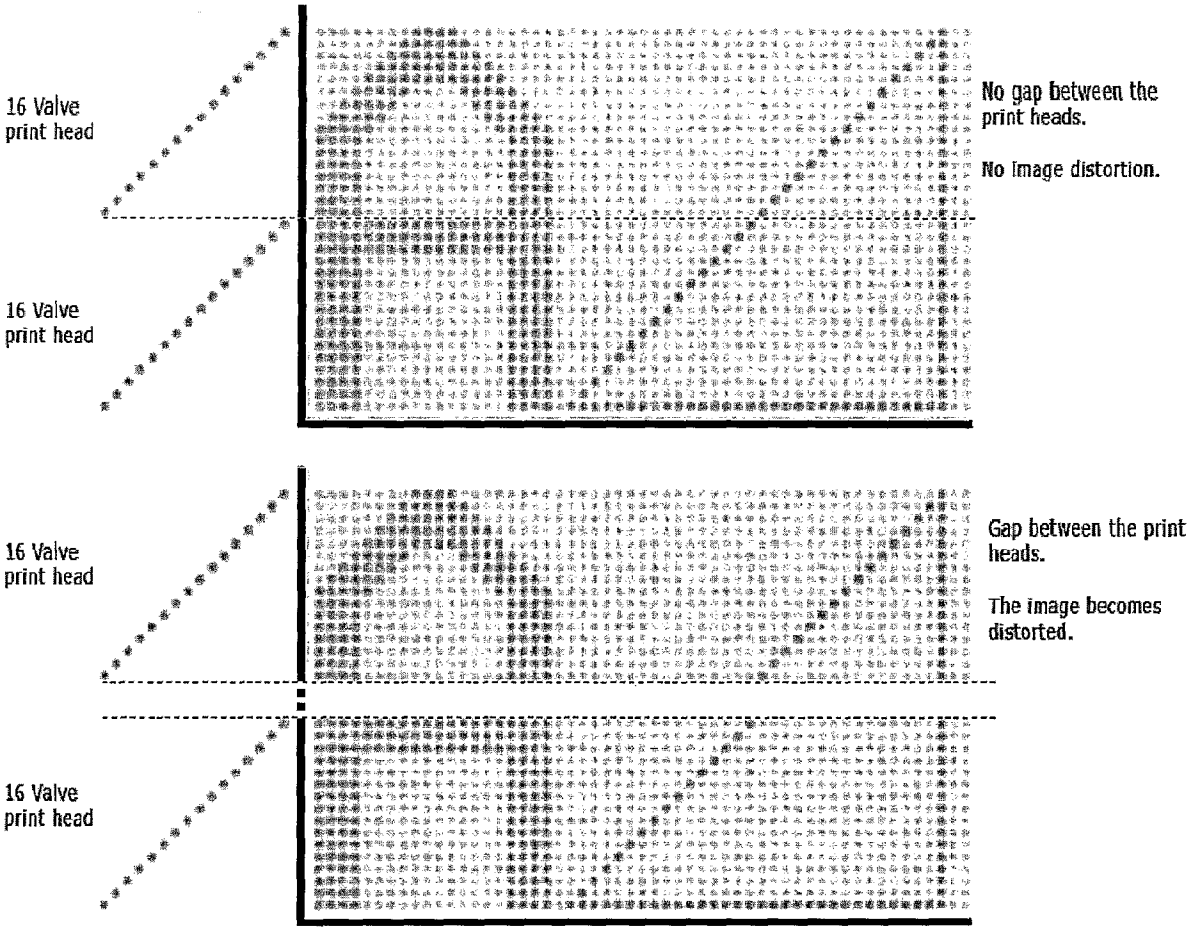
Figure 13:
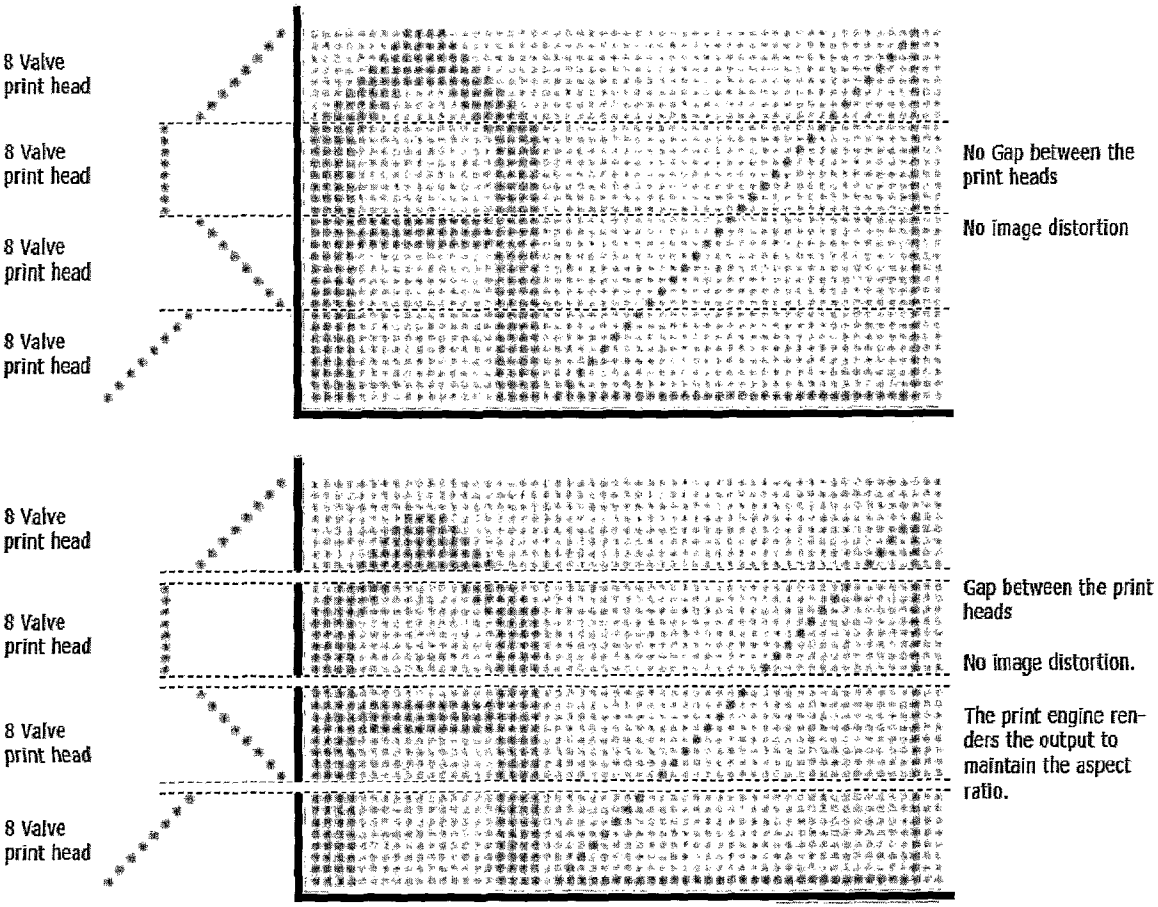

Referring to FIG. 11 the PE interface allows the logic core to access up to M (Where M is the number of PE/Encoder interfaces required) independent PE triggers. Typically the system has 4 PE interfaces and these triggers can be routed into any of the N/16 (Where N is the number of jets in the given system) jet banks. The Synchronisation section of the PE interface allows us to synchronise the PE signals up with the 100 MHz system clock. As the PE signal comes into the system they are run through a "Double Buffer" and this buffer is used to remove all of the possible glitch signals and synchronises it to the system clock. The PE Output Multiplexer allows the pass the synchronised PE information into one or many jet banks.

Figure 14:
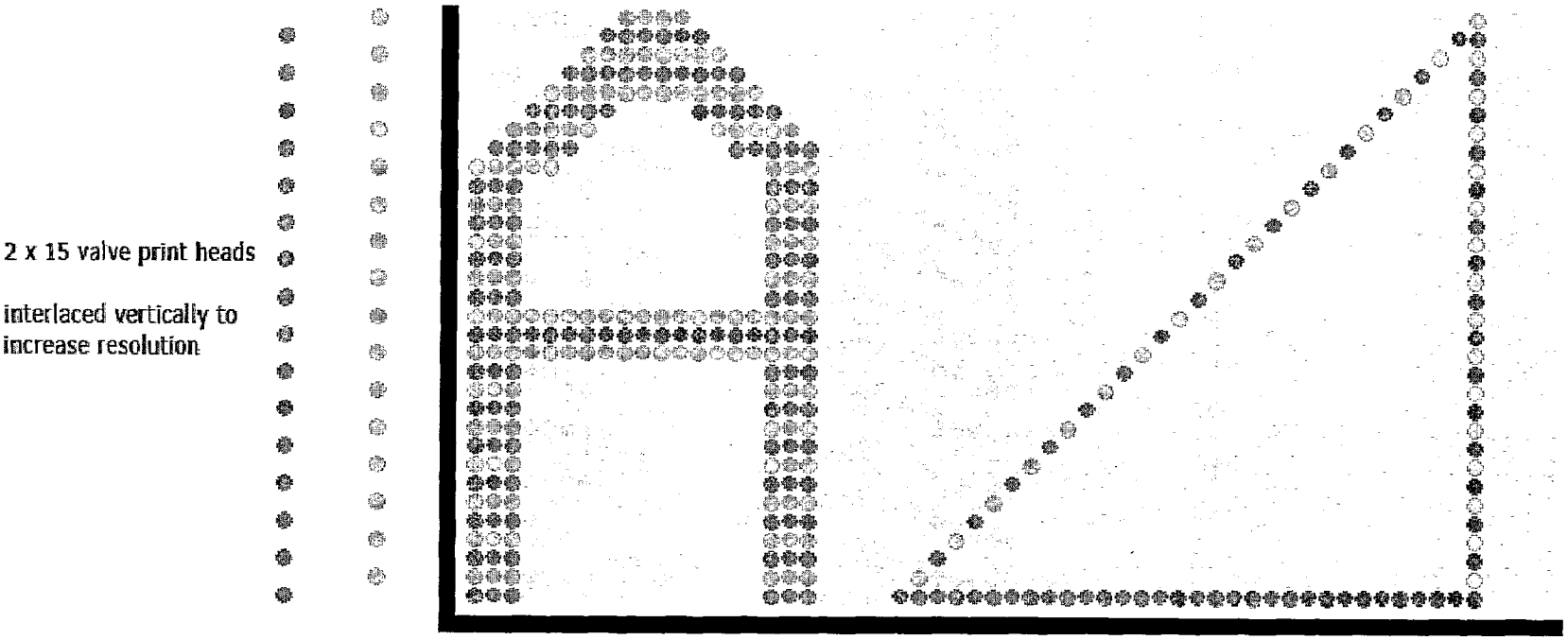
FIG. 14 are diagrammatic views of printing results using 2 print heads in the Y axis to improve print head resolution.
Figure 15:
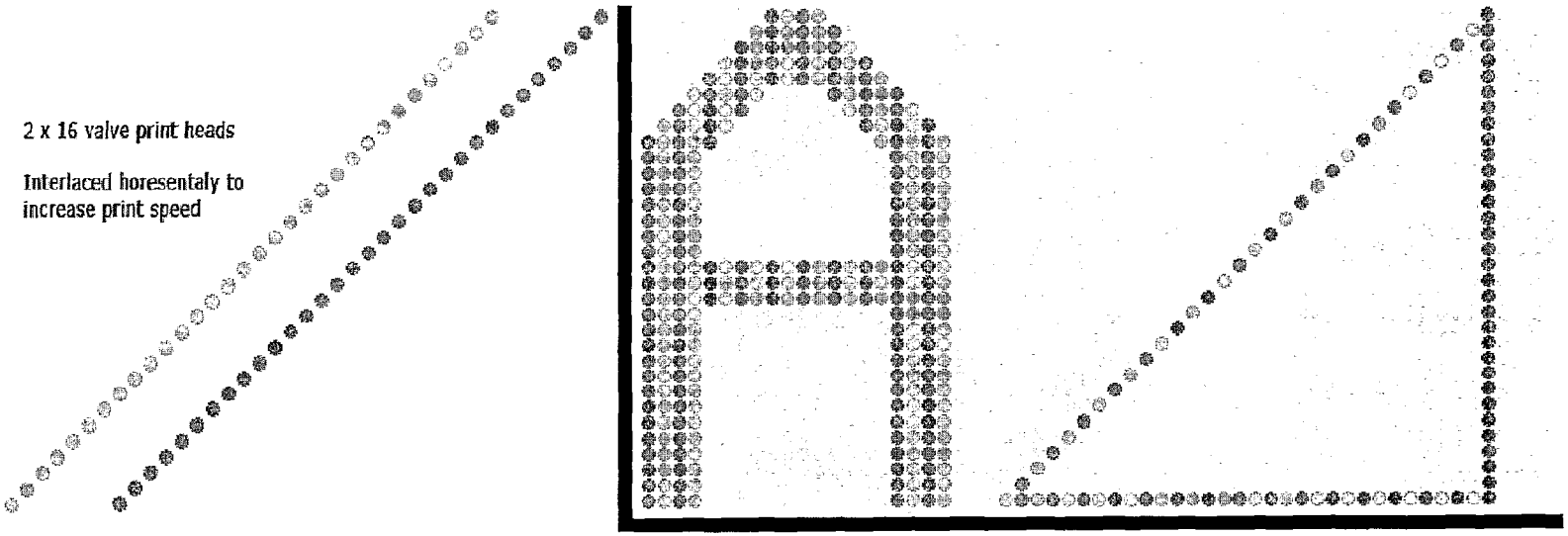
FIG. 15 are diagrammatic views of printing results using 2 print heads in the X axis to improve print speed and print head performance.
Figure 16:
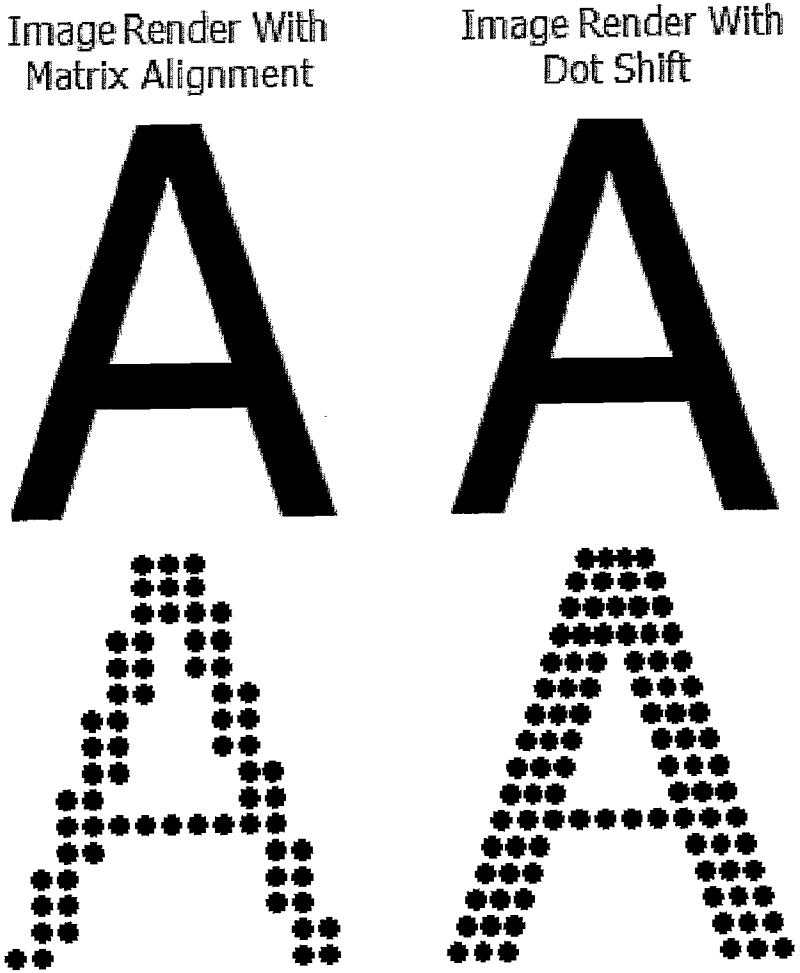
FIGS. 16 and 17 are diagrammatic views of printing results using multiple print heads in the system of an embodiment of the invention in comparison with other image render or vector render matrix alignment systems.
Figure 17:
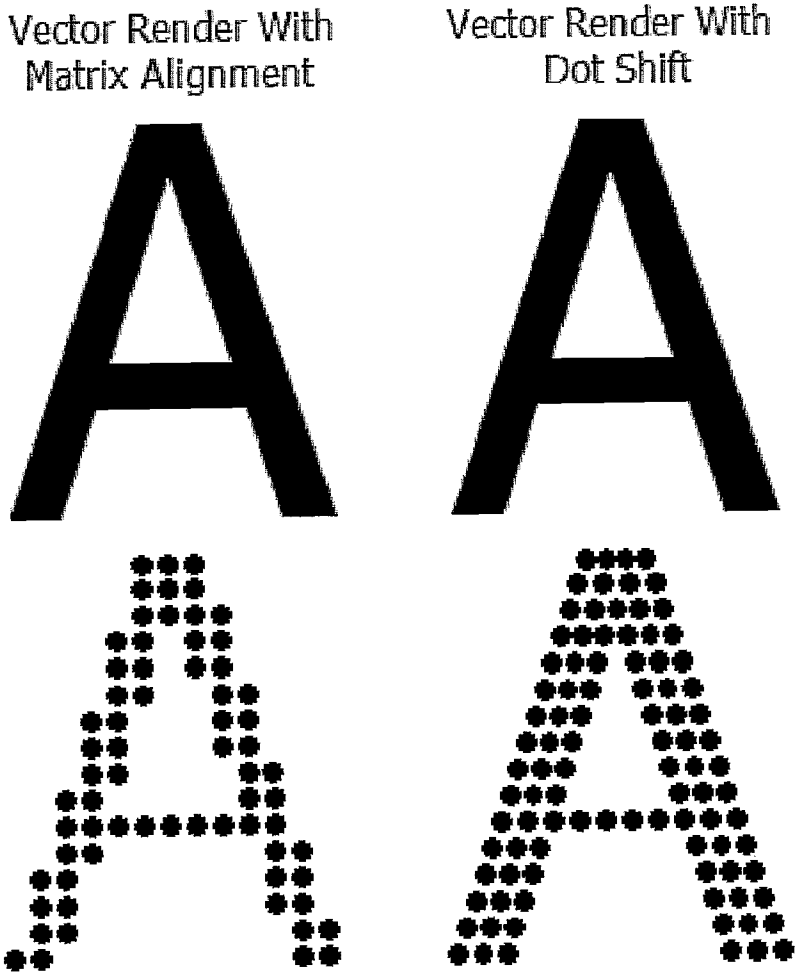
Figure 18:
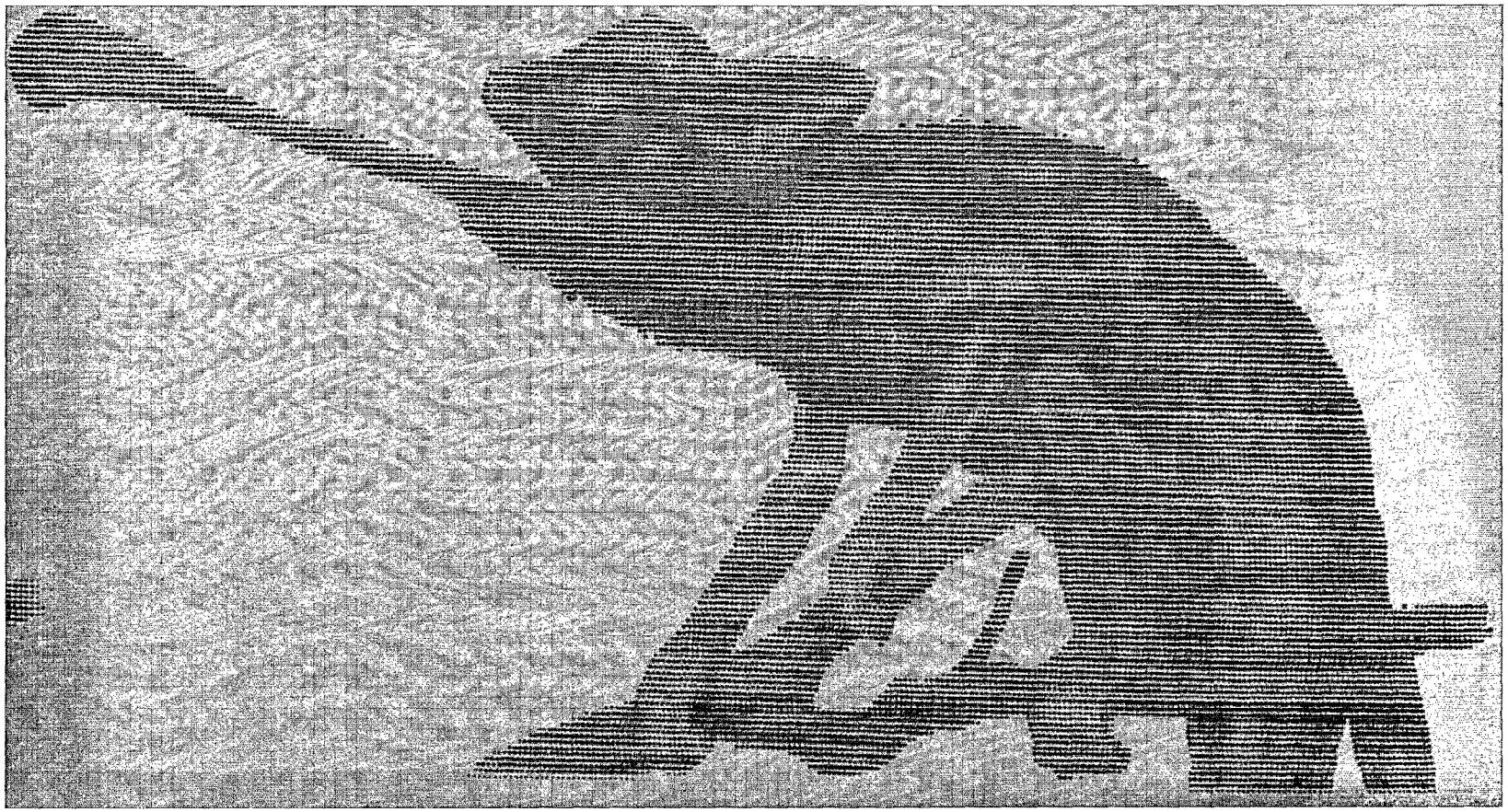
FIG. 18 is a diagrammatic view of an example of a result of the print generation system of an embodiment of the invention using a DOD print system.

With reference to FIGS. 14 and 15 an important aspect to obtain printing at required resolution is to undertake rendering at required resolution. By the present system this can be at different resolution for different parts of the same image such as shown in FIG. 16.

With Bitmap Text, when rendering the bitmapped text the system loads up a specific graphic that represents a character. This character has already been pre-sized. Then rendering engine then scans through the image and with no alteration or reprocessing of it adds it to the print buffer. In this mode the rendering engine does not take into account the jet position in either the X or Y plane. The only variables that it uses when doing this generation method is the DPI (Dots per inch) and Darkness, which are both user specified. Each Character or Character string can have a different DPI associated with it as well as a different darkness/Dot size.

The System has a set of pre-defined character sizes. These are:—(Width×Height in dots)

5×5
7×5
9×7
14×11
16×11
21×17
32×23

Note: Extra sizes can be added at any time.

With Vector Text, when rendering the Vector based characters, the system will load a font file. In this font file the system has access to character arrays that contain >1000 vector points (required to draw large high resolution characters) per character. Once the desired character is loaded the rendering engine will perform the following:

1. The system then calculates the character height. This is based on the print heads angle and DPI requirements.
2. The rendering engine will then scale the vector character to fit the given character height calculated.
3. The rendering engine will then scan the vector arrays using vector interference to work out all of the intersect points for each of the jet positions.
4. Once all of the interference points are found the rendering engine will then take those points and fill back space where required between them at the given DPI/Darkness requested and add the information to the print buffer.

When the rendering engine renders in this mode it will maintain the aspect ratio of each character generated and allows for gaps in the print and different print head technologies being used.

Since this method is based on an array of positions it takes advantage of the absolute dot positioning of the print engine and does not try in any way to make the print conform to a matrix. Each row of jets is handled individually from each other and the system allows for a 0.01 mm dot resolution/dot shift.

With Smoothed Bitmap Text rendering, the system loads a pre-generated character. This character must be of sufficient resolution so when the system scales the image it does not distort. The rendering engine will perform the following:

1. The system then calculates the character height. This is based on the print heads angle and DPI requirements.
2. The rendering engine will then scale the character to fit the given character height calculated.
3. The rendering engine will then scan the image using interference detection to work out all of the intersect points for each of the jet positions.
4. Once all of the interference points are found the rendering engine will then take those points and fill back space where required between them at the given DPI/Darkness requested and add the information to the print buffer.

When the rendering engine renders in this mode it will maintain the aspect ratio of each character generated and allows for gaps in the print and different print head technologies being used.

Since this method is based on an array of positions it takes advantage of the absolute dot positioning of the print engine and does not try in any way to make the print conform to a matrix. Each row of jets is handled individually from each other and the system allows for a 0.01 mm dot resolution/dot shift.

When rendering a bitmapped picture then system loads the specified image. This image is then scaled across the selected number of jets. When the image is scaled the system will ensure that the aspect ratio is maintained. Once the image is prepared the system will perform the following:

1. The image will be sliced up into the number of jets. When this is done the rendering engine will vary the size of the slice depending on the print head angle and DPI requirements.
2. The rendering engine will then scan along each slice calculating the average color for each of the vertical segments and convert it to gray scale.
3. Once the average colors are found then the rendering engine will then scan along the segment and find the start and end of each shade of gray and add the appropriate information to the print buffer.

This mode of generation still conforms to the matrix alignment method, but adds gray scale shading to the printed image.

When rendering a smoothed bitmapped picture then system loads the specified image. This image is then scaled across the selected number of jets. When the image is scaled the system will ensure that the aspect ratio is maintained. Once the image is prepared the system will perform the following:

1. The image will be sliced up into the number of jets. When this is done the rendering engine will vary the size of the slice depending on the print head angle and DPI requirements.
2. The rendering engine will then scan along each slice calculating the average color for each of the vertical segments and convert it to gray scale.
3. Once the average colors are found then the rendering engine will then scan along the segment and find the start and end of each shade of gray and add the appropriate information to the print buffer.

This mode of generation still conforms to the absolute positioning alignment method.

Using this method each object that is being rendered by the system can be rendered with a different Resolution/DPI. This allows the system to uniquely adjust each printed object to optimize its appearance and quality. Given that the system is accurate down 0.01 mm in the X axis the system can have the DPI set up to a value >2500. When the system has been setup with interlaced print heads in the Y axis we can also achieve much higher resolutions and are not longer restricted by print head angles and print head mechanical sizes. This improves printed picture quality.

It should be understood that the above description is of a preferred embodiment and included as illustration only. It is not limiting of the invention. Clearly a person skilled in the art without any inventiveness would understand variations of the drop on demand printing system and such variations are included within the scope of this invention as defined in the following claims.

The invention claimed is:

1. A controller for a coding and marking printing system having a central processing unit and a controller for driving a plurality of print heads for printing, a. the central processing unit for providing a plurality of instructions for defining a plurality of instructions for the control system to individually control the release of the ink of each print head nozzle according to an image and a determined dot formation representation of the image;

b. the controller including a plurality of modules with each module having a print drive interface connectable to the print heads and a control system including an encoder and a printer logic core having core printer functions, and which through a jet drive interface communicate with a jet bank interface to drive the print heads wherein the printer logic core can control the initiation of the release and the time of the release of the ink of each print head nozzle, wherein the printer logic core receives a rendered image and is connected to the print drive interface for controlling the print heads such that the control system initially receives the plurality of instructions of the rendered image from the central processing unit and individually controls each print head according to the inputted rendered image and a determined dot formation representation of the rendered image by logic and core printer functions without further recourse to the central processing unit.

2. A controller for a coding and marking printing system according to claim 1, wherein the control system determines defined print instructions using absolute positioning of dots in at least one direction and substantially only limited by the size of the dots thereby allowing for controlling of position of dots anywhere along at least one direction of the print lines and wherein the control system determines defined print instructions for interlaced print heads in at least one direction whereby the absolute positioning of dots is undertaken by any one of the interlaced print heads in at least one direction and substantially only limited by the size of the dots thereby allowing for controlling of position of dots anywhere along at least one direction of the print lines; and wherein the control system determines absolute positioning of dots and if two individual dot position instructions overlap determines to ignore one of the individual dot position instruction whereby avoiding dot smudge or print head damage.

3. A controller for a coding and marking printing system according to claim 1, wherein the printer logic core of the control system includes a data address interface that receives a plurality of instructions from control systems for controlling the initiation and the time of action of each print head; and wherein the control system drives the print heads by a step voltage over a predefined step timing and a respective hold voltage over a determined hold timing dependent on the respective dot portion of the determined dot formation representation of the inputted rendered image.

* * * * *